US005129852A

United States Patent [19]

Crisci et al.

[11] Patent Number: 5,129,852

[45] Date of Patent: Jul. 14, 1992

[54] TOY AIRPLANE LAUNCHER AND WINDER

[76] Inventors: Louis Crisci, 406 N. Putnam Ave., Lindenhurst, N.Y. 11757; Martin Mallin, 3288 Hewlett Ave., Merrick, both of N.Y. 11566

[21] Appl. No.: 755,091

[22] Filed: Sep. 5, 1991

[51] Int. Cl.[5] ..... A63H 27/14; A63H 27/22

[52] U.S. Cl. ..... 446/60; 446/65

[58] Field of Search ..... 446/60, 59, 57, 64, 446/65, 259, 429, 430; 244/63

[56] References Cited

U.S. PATENT DOCUMENTS

| | | | |
|---|---|---|---|
| 1,565,437 | 12/1925 | Greife | 446/65 |
| 1,972,117 | 9/1934 | Walker | 446/60 |
| 2,731,769 | 1/1956 | Holt | 446/57 |
| 2,788,613 | 4/1957 | Gelfand et al. | 446/429 |
| 2,976,644 | 3/1961 | Crisci | 446/65 |
| 3,222,816 | 12/1965 | Effinger, Jr. et al. | 446/60 |
| 4,067,139 | 1/1978 | Pinkerton et al. | 446/57 X |

FOREIGN PATENT DOCUMENTS

| | | | |
|---|---|---|---|
| 516945 | 1/1931 | Fed. Rep. of Germany | 446/64 |

*Primary Examiner*—Mickey Yu

*Attorney, Agent, or Firm*—Bryan, Levitin, Franzino & Rosenberg

[57] ABSTRACT

A toy airplane launcher apparatus includes a toy airplane having an electric or rubberband motor for rotating a prop which is rotatably mounted to the airplane. The launcher includes a guide rail which slidably carries a rear launcher section which is slidable into engagement with a front launcher section engaged to the front end of the guide rail. Two rubberbands are engaged between the front and rear launcher sections to hold them together and for biasing the rear launcher section toward the front launcher section when the two are separated from each other. The rear launcher section is engageable with the trigger and is either fixed to or detachably engaged with the airplane. When the trigger is moved, the rear launcher section moves quickly along the rail into engagement with the front launcher section. If the rear launcher section is fixed to the airplane, both front and rear launcher sections leave the rail and are launched along with the airplane. If the rear launcher section is merely engaged with the airplane, the two launcher sections stay on the rail allowing the airplane to be launched along. A winder forms part of the launcher and either charges the power supply for the electric motor or winds the rubberband motor. Advantageously, the propeller is allowed to rotate only as or after it is launched.

7 Claims, 3 Drawing Sheets

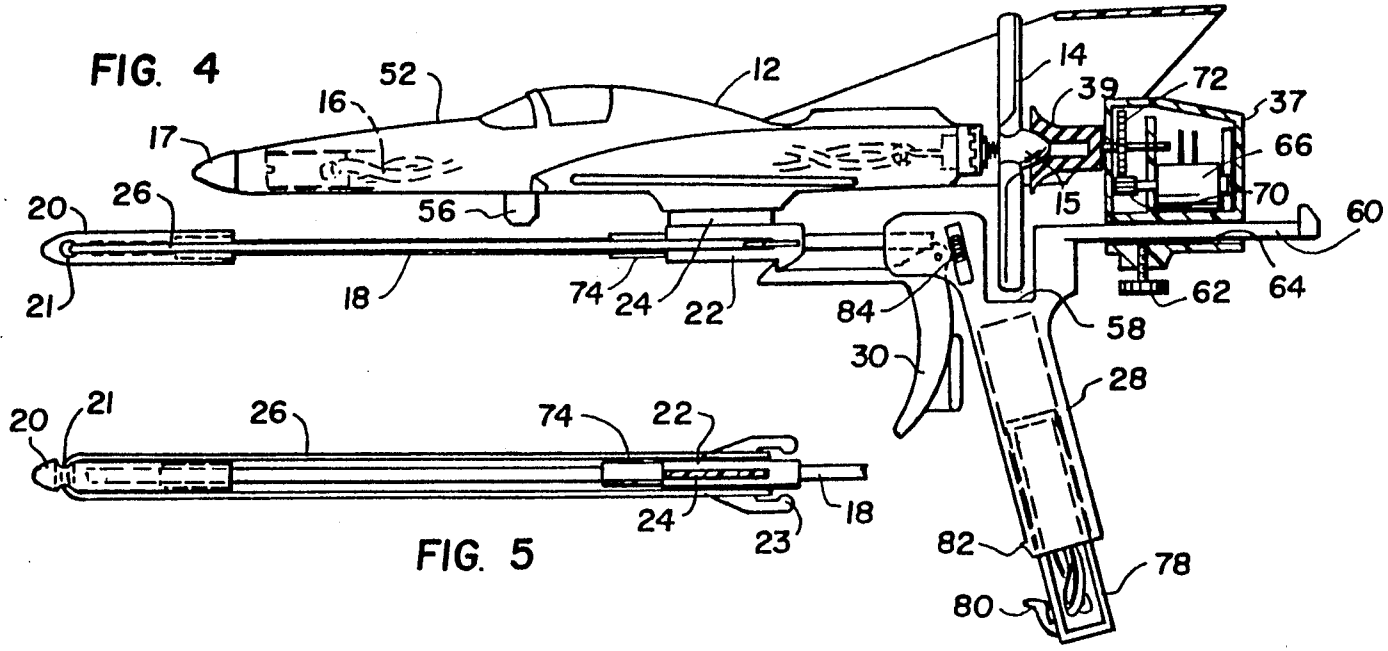
FIG. 4
FIG. 5
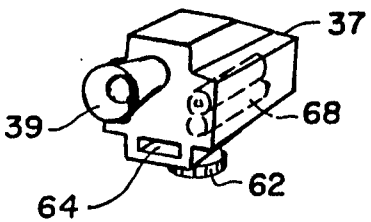
FIG. 6
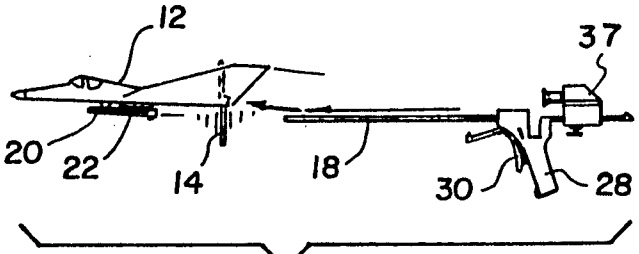
FIG. 7

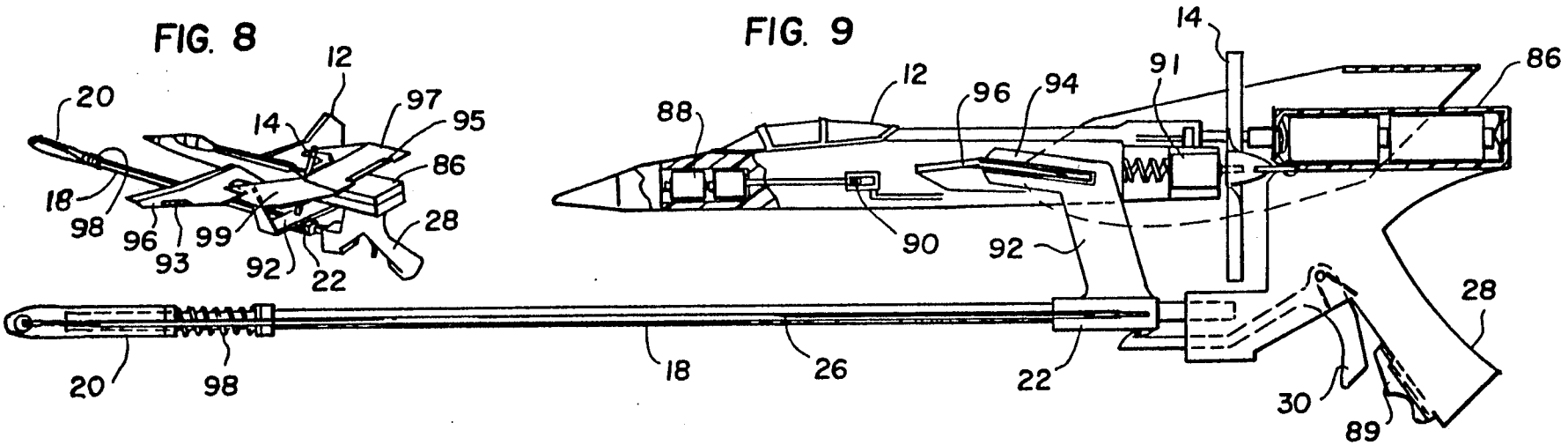
FIG. 9
FIG. 8
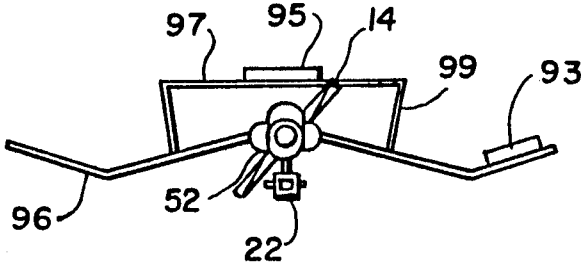
FIG. 10

TOY AIRPLANE LAUNCHER AND WINDER

FIELD AND BACKGROUND OF THE INVENTION

The present invention relates in general to powered toy airplanes, and in particular to a new and useful launcher particularly for windup airplanes, which incorporates a winder mechanism.

U.S. Pat. No. 2,976,644 issued to the inventor of the present application, discloses a toy missile which incorporates a rubberband powered launcher. The missile which is advantageously in the form of an airplane, has a rear portion carrying wings and a tail section, and a forward portion which is separable from the rear portion. A plurality of rubberbands are engaged around hooks on the front and rear portions to hold the two portions of the airplane to each other. A bore extends completely to the rear portion of the aeroplane and extends as a blind bore into the forward section of the airplane. A launcher in the form of a handle, trigger and guide rod are used in conjunction with the airplane. To launch the airplane, the rod is inserted through the bore of the rear section and engaged into the blind bore of the front section. The rear section is then pulled rearwardly until it reaches a hook connected to the trigger. The separation between front and rear sections of the airplane stretch the rubberbands and prepare the airplane for launch. By pulling the trigger, the rear section is released and rapidly slides along the rod until it engages the front section. The forward momentum of the rear section then launches the entire airplane, including its front section, off the rod and into flight. The airplane may also include an on-board jet assist unit for lengthening the flight.

Prop-driven rubberband powered toy airplanes are also known. The prop is manually rotated to twist the rubberband which stores potential energy. Generally, the prop is released at the same time the airplane is thrown into the air to add some boost to the trust of the rotating prop. Although effective, this system is wasteful of the very limited energy which can be stored by the rubberband motor in that the propeller usually turns multiple times before the airplane is launched, thus losing the higher energy of the rubberband motor which is available in the first instant after the prop is released.

SUMMARY OF THE INVENTION

An object of the present invention is to provide a self powered toy airplane and launcher combination which releases the airplane prop only after the airplane has cleared the launcher or, at the latest, at the instant when the airplane is released. The invention operates both with rubberband motor powered airplanes by incorporating a motor driven winder and launch assembly which both winds the prop and thereafter releases the prop only after the airplane has clear the launcher, or a battery powered charger which is engaged to charge batteries or other electric power storage means, up to the instant when the airplane is released.

Another feature of the present invention which improves the toy airplane's aerodynamic characteristics, is the use of a one or two percent down thrust position for the prop and a one or two percent side thrust position. The side thrust position is in a direction to compensate for counter-rotation of the airplane due to spinning torque of the prop. The down thrust position has been found to improve aerodynamic stability of the airplane.

Another feature of the invention which improves the aerodynamics of the airplane is the use of trim tabs on the elevator and on one of the wings. The trim tab on the single wing is also utilized to compensate for prop torque.

The wings may also include two bends each for giving the wings an inverted wing dihedral which gives the model airplane stability by forming a pocket of air under the wings on which the airplane floats.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 4 is a side elevational view similar to FIG. 1, partly in section and showing an alternate embodiment of the present invention;

FIG. 5 is a partial top plan view of the forward portion of the launcher of FIG. 4;

FIG. 6 is a perspective view of the winder of FIG. 4;

FIG. 7 is an exploded side elevational view showing the airplane just leaving the launcher of FIG. 4;

FIG. 8 is a perspective view of a further embodiment of the invention including an airplane, a launcher and a charger;

FIG. 9 is a side elevational view of FIG. 8; and

FIG. 10 is a front elevational view of a airplane illustrating a further embodiment of the invention.

DESCRIPTION OF THE PREFERRED EMBODIMENTS

Figure 1:
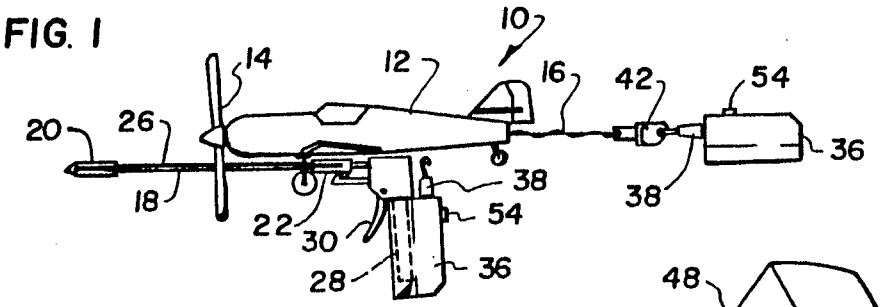
FIG. 1 is a side elevational view of an airplane with launcher and winder constructed in accordance with the present invention.
Figure 2:
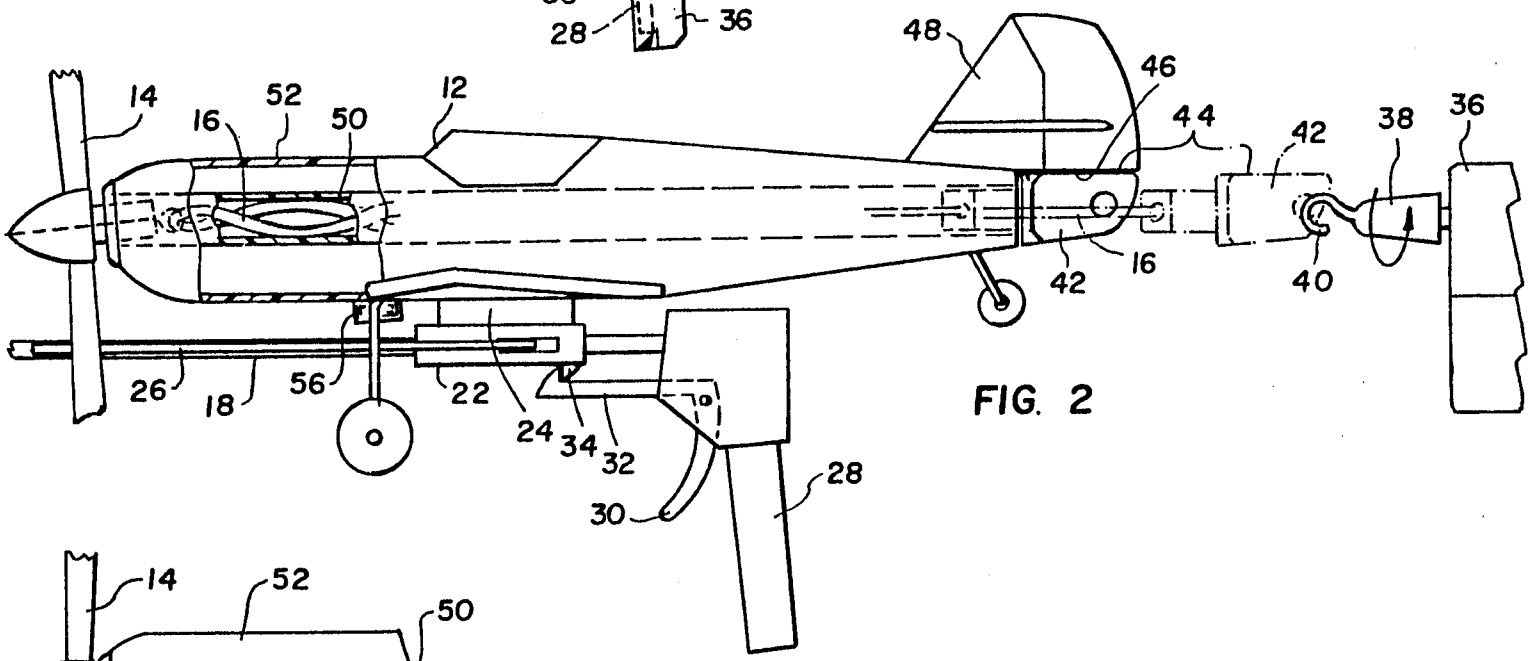
FIG. 2 is a partial enlarged view similar to FIG. 1.

Referring to the drawings in particular, the invention embodied in FIGS. 1 and 2 comprises a toy airplane launcher apparatus generally designated 10 having a toy airplane 12 with a prop 14 rotatably mounted thereto and energy storage means such as a rubberband motor 16 onboard the airplane for storing energy which can be released to the prop for rotating the prop.

Apparatus 10 also includes a launcher which comprises an elongated guide rail 18 with a front launcher section 20 detachably engaged to a front end of the rail. A rear launcher section 22 is engaged with and slidable along the guide rail 18 for movement into engagement with the front launcher section. The rear launcher section is fixed to the underside of the airplane fuselage 52 by a flat projection 24 best shown in FIG. 2.

Biasing means in the form of rubberbands 26 are engaged between the front and rear launcher sections 20, 22, on opposite sides of the launcher sections, for biasing the rear launcher section toward the front launcher section and providing the launching force for launching airplane 12 from the launcher.

A handle 28 is connected to a rear end of guide rail 18 and carries a spring loaded trigger 30 which is pivotally mounted to the handle. A release hook 32 which is fixed to the trigger 30 is engaged with a finger 34 of the rear launcher section 22 for retaining the rear launcher section in a rear cocked position, in preparation for launch.

In order to wind the rubberband motor 16 which forms energy storage means for rotating the prop, a battery operated winder 36 which includes a recess for closely receiving and thus being held on the handle 28, is disconnected from the handle. An internal motor and battery of conventional design (not shown) in winder 36 rotate a winding hub 38. Winding hub 38 includes a winding hook 40 which is engagable through a hole in a tail piece 42 having a flat upper surface 44 engagable under a corresponding flat surface 46 of a tail section 48 of the airplane 12. In FIG. 2, tail piece 42 in its solid line position is shown engaged under the tail section and thus precluded from rotation. Rubberband motor 16 is connected at one end to the tail piece 42 and is normally inside a support tube 50 positioned within a through hole in fuselage 52 of the airplane 12. When tail piece 42 is pulled from under the tail section as shown in FIG. 1, a switch 54 on winder 36 is moved to start rotation of hub 38 and thus wind up the rubberband motor 16. Since tail piece 42 is clear of tail section 48, it is free to rotate. Once sufficient winding has been completed to charge the rubberband motor, tail piece 42 is allowed to return to its position under tail section 48 where it is precluded from rotation by the engagement between flat surfaces 44 and 46. The winder 36 may then be returned to the handle 28 and the launcher prepared for launch. Prop 14, before the airplane is launched, has a rotation path which is intersected by guide rail 18 thus precluding the propeller from rotating.

When trigger 30 is pulled, rear launcher section 22 is released and moves rapidly under the influence of rubberbands 26 into engagement with front launcher section 20. Both launcher sections and the airplane thereafter leave the guide rail 18 and are launched into flight. Only after the prop 14 clears the guide rail 18, is it allowed to rotate, thus maximizing the launching speed and the amount of energy available to the airplane the instant it is launched. Since the front and rear launcher sections are under relatively large forces during the launching operation, a stopper 56 is placed under fuselage 52 to engage and cushion the front launcher section in case it is urged upwardly toward the fuselage under the large forces. Rubberbands 26 also serve to hold the front and rear launcher sections together during the flight.

Figure 3:
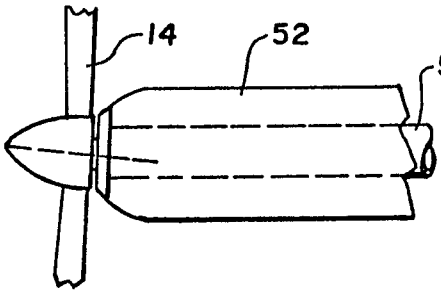
FIG. 3 is a partial top plan view of the forward part of the airplane shown in FIG. 2.

To improve the flying characteristics of the airplane and compensate for torque which tends to turn the airplane in a direction opposite to the direction of rotation of prop 14, the prop is mounted at a one or two percent side thrust as shown in FIG. 3, which represents approximately a one or two degree angle for the axis of rotation of the prop 14 with respect to the main axis of the fuselage 52. As shown in FIG. 2, prop 14 is also mounted at a one or two percent down thrust with respect to the main axis of the fuselage. This has been found to improve flight characteristics particularly under the large launching forces and subsequent self propelled forces experienced by the airplane.

In the remaining figures, the same reference numerals are utilizes to designate the same or functionally similar parts.

In the embodiment of FIG. 4, prop 14 is a so-called "push-prop" and is rotatably mounted to the rear of the fuselage 52. Handle 28 connected to the rear end of guide rail 18 includes a U-shaped prop well 58 which receives the path of rotation for prop 14 when the rear launcher section 22 is engaged with the trigger 30. In this position, a spinner 15 of prop 14 is fractionally engaged with a rubberband winding hub 39 which is mounted for rotation to a winder 37 which is positioned at adjustable fixed locations along a rear projection 60 extending rearwardly of handle 28. A housing of winder 37 includes an opening 64 which receives the rear projection 60. In operation, a set screw 62 is loosened and the winder housing is moved to the left in FIG. 4 until hub 39 fractionally engages spinner 15. In this position, screw 62 is tightened to fix the winder in place. Hub 39 has a funnel shaped inlet to help center the spinner 15 in the hub.

A motor 66 in the winder 37 is powered by batteries 68 (see FIG. 6) and, through a pinion gear 70 connected to the motor shaft and a large spur gear 72 meshed with the pinion gear and fixed to the hub 39, rotates the prop for winding the rubberband motor 16. Winding continues until the frictional engagement is overcome and a static torque condition is established between hub 39 which continues to spin and prop 14 which is held to keep the rubberband motor wound. During this steady state condition, trigger 30 is pulled to release the rear launcher section 22 which, by the biasing of rubberband 26, moves forwardly quickly to engage the front launcher section 20 which, together with the airplane, leave the guide rail 18. While airplane 12 moves along the guide rail, prop 14 is prevented from turning since it immediately rotates against guide rail 18 after it leaves well 58, until the prop clears the guide rail as shown in FIG. 7. Just as in the embodiment of FIG. 1, thus the airplane has a fully charged or wound motor, the moment it leaves the launcher.

In FIG. 4, rear launcher section is shown to include a cylindrical post 74 which engages into a cylindrical blind bore in front section 20, to further strengthen the engagement between the launcher sections after the airplane has been launched.

Handle 28 also includes a storage drawer 78 which may contain extra rubberbands and the like, and which can be slid up into the hollow handle 28 and held in place by a clip 80 snapped onto a finger 82.

The embodiment of FIGS. 4 and 5 also use a single rubberband 26 which is looped through a hole 21 in the front launcher section 20, with opposite ends of the rubberband being hooked around a pair of hooks 23 fixed to the sides of rear launcher section 22. Handle 28 also includes a safety lock 84 which prevents trigger 30 from moving until the safety lock is lowered. Airplane 12 also has a rubber tip 17 for safety.

FIGS. 8 through 10 illustrates a further embodiment of the invention where a battery charger 86 containing a plurality of large batteries is detachably connected to electrical contacts at the rear of an airplane 12 which contains smaller rechargeable batteries 88 which are connected by a switch 90 to an onboard motor 91 for rotating the prop 14. In this embodiment of the invention, the charging means comprise an electrical charging arrangement rather than a rubberband motor winder. The central characteristic of the invention remains the same in that maximum energy storage is desired at the moment the airplane is launched.

The embodiment of FIG. 9 also differs in that the front launcher section 20 is fixed to the front end of guide rail 18 while the rear launcher section 22 is detachably engaged to the airplane. For this purpose, rear launcher section 22 includes a support 92 with a pair of upwardly extending fins which have upper slots 94 that engage rear edges of the wings 96 of airplane 12. When trigger 30 is pulled, rear launcher section 22 is released and, through the influence of rubberband 26, moves rapidly into engagement with front launcher section 20. Both launcher sections remain on the guide to 18 while the airplane is launched. To buffer the engagement between the launcher sections, a shock absorbing spring 98 is connected to the rear end of front section 20.

A safety block 89 is slidably mounted to the front surface of handle 28 to be upwardly slid behind trigger 30 to prevent its being pulled until ready.

Contacts between the charger 86 and the battery 88 are at the rear of the airplane fuselage and automatically disconnect when the airplane is launched. Alternately, they may incorporate a switch which automatically connects motor 91 to batteries 88 when the airplane is launched. Switch 90 is used as an overall power switch to open or close the circuit between the batteries and motor. Instead of batteries 88, other electrical storage means may be utilized such as capacitors.

FIG. 10 is a front elevational view of an airplane which can be used with the launchers of the present invention. It includes a fuselage 52 having wings 96 connected to opposite sides of the fuselage and bent into an inverted wing dihedral which has been found to stabilize the airplane's flight as it floats over a pocket of air formed under the wings. The airplane of FIG. 10 includes a one piece tail section 99 with an elevator 97 having a bendable trim tab 95. At least one wing 96 is also provided with a bendable trim tab 93 which is bent to counteract the torque of prop 14. This has been found to maintain straight flight when the airplane is launched.

While specific embodiments of the invention have been shown and described in detail to illustrate the application of the principles of the invention, it will be understood that the invention may be embodied otherwise without departing from such principles.

What is claimed is:

1. A toy airplane launcher apparatus, comprising:

a toy airplane;

a prop mounted for rotation to a rear end of said airplane;

energy storage means onboard said airplane for storing energy which is releasable to said prop for rotating said prop to propel said airplane;

a launcher guide rail;

a front launcher section engaged to a front end of said guide rail;

a rear launcher section engaged with and slidable along said rail for movement into engagement with said front launcher section, said rear launcher section being engaged with said airplane for moving said airplane along said guide rail with movement of said rear launcher section;

biasing means connected between said front and rear launcher sections for urging said rear launcher section toward said front launcher section;

trigger means movably mounted to said guide rail and engagable with said rear launcher section for retaining said rear launcher section at a spaced location away from said front launcher section, and for releasing said rear launcher section with movement of said trigger means so that said rear launcher section moves toward said front launcher section under the influence of said biasing means;

charging means detachably connected to said energy storage means for storing energy in said energy storage means;

said energy storage means comprises a resilient member connected to said prop and windable to store energy for rotation of said prop, said charging means comprising a winder detachably connected to said resilient member for winding said resilient member;

said winder being fixable to said guide rail, said winder having a rotatable hub engagable with said prop for winding said prop to wind said resilient member, said prop being disengaged from said hub when said trigger means is moved to move said rear launcher section with said airplane away from said hub, said prop being rotatable in a path, said path being clear of said guide rail when said rear launcher section is engaged with said trigger means, and said guide rail being in said path as said rear launcher section moves along said guide rail after said trigger means has been moved.

2. An apparatus according to claim 1, wherein said front launcher section is fixed to the front end of said guide rail, said rear launcher section being detachably engaged with said airplane and said airplane being launched from said guide rail after said rear launcher section engages said front launcher section.

3. An apparatus according to claim 1, wherein said airplane has a fuselage with a main axis, said propeller being mounted and a small down angle and small side angle with respect to said axis.

4. An apparatus according to claim 3, wherein said down angle is from 1° to 2° and said side angle is from 1° to 2°.

5. An apparatus according to claim 1, wherein said airplane has a fuselage, a pair of wings connected to said fuselage, and an elevator connected to said fuselage, at least one of said wings having a trim tab pivotally mounted to said wing.

6. An apparatus according to claim 5, including a trim tab pivotally mounted to said elevator.

7. An apparatus according to claim 1, wherein said airplane comprises a fuselage, a pair of wings connected to said fuselage, said wings including an inverted wing dihedral.

* * * * *